United States Patent [19]

Petersson et al.

[11] 4,144,055

[45] Mar. 13, 1979

[54] METHOD OF PRODUCING BLISTER COPPER

[75] Inventors: Stig A. Petersson; Bengt S. Eriksson, both of Skelleftehamn, Sweden

[73] Assignee: Boliden Aktiebolag, Stockholm, Sweden

[21] Appl. No.: 774,454

[22] Filed: Mar. 4, 1977

[30] Foreign Application Priority Data

Mar. 12, 1976 [SE] Sweden ..... 76032382

[51] Int. Cl.[2] ..... C22B 15/06

[52] U.S. Cl. ..... 75/73

[58] Field of Search ..... 75/72, 74, 76, 24, 73, 75/75

[56] References Cited

U.S. PATENT DOCUMENTS

| | | | |
|---|---|---|---|
| 3,666,440 | 5/1972 | Kono et al. | 75/76 |
| 3,682,623 | 8/1972 | Dierckx et al. | 75/76 |
| 3,890,139 | 6/1975 | Suzuki et al. | 75/74 |
| 4,006,010 | 2/1977 | Rajcevic et al. | 75/74 |
| 4,032,327 | 6/1977 | Donaldson et al. | 75/72 |

*Primary Examiner*—M. J. Andrews

*Attorney, Agent, or Firm*—Stevens, Davis, Miller & Mosher

[57] ABSTRACT

A method of producing blister copper comprising smelting sulphidic copper raw material in a rotary furnace with an inclined rotation axis, in presence of oxygen and slag formers charged simultaneously with the copper raw material. The method comprises discontinuing the oxygen charge when at least 75% of the copper raw material has been charged and treating the obtained matte and slag with a reduction agent and then transferring the matte and the slag together to a holding furnace in which the matte and the slag are separated and transferring the matte in the holding furnace to a converter where it is converted to blister copper.

10 Claims, 1 Drawing Figure

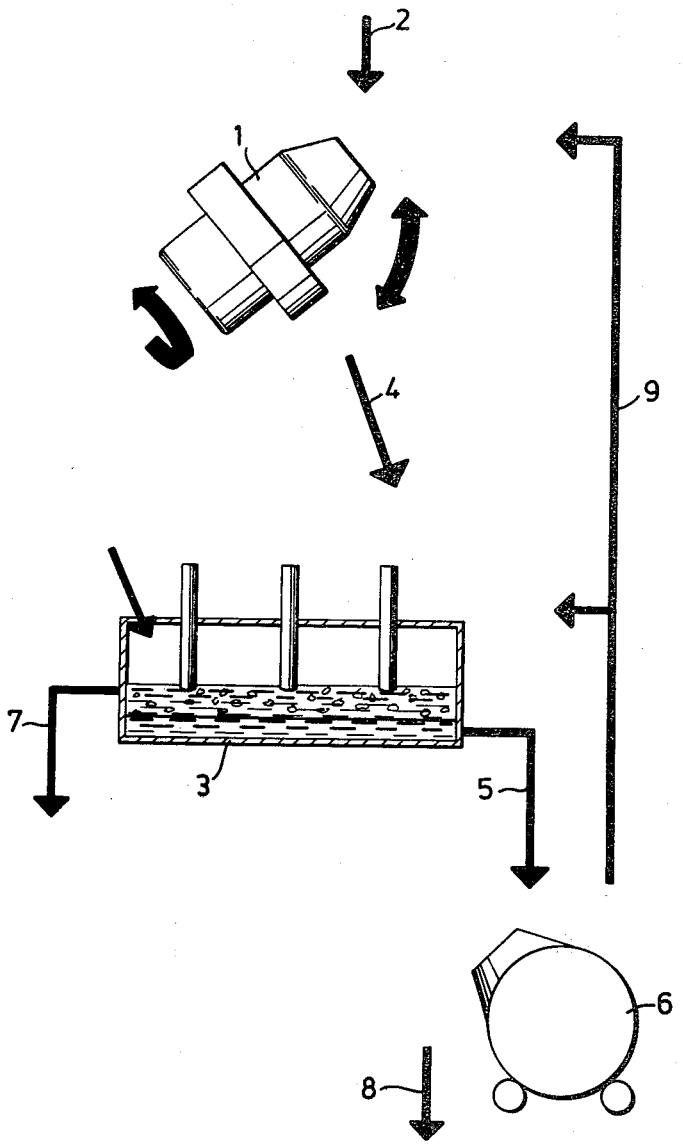
2
1
4
9
7
3
5
6
8

METHOD OF PRODUCING BLISTER COPPER

The present invention relates to a method of producing blister copper from sulphidic copper material, the sulphidic copper material being smelted down discontinuously in a furnace to form a matte having a high copper content and a slag having a relatively low copper content, whereafter the molten material, comprising slag and matte, is transferred to a settling furnace in which the slag is treated to reduce the copper content thereof, whereafter the slag and the copper matte are continuously tapped-off together. The copper matte is then after separation from the slag converted to blister copper in a conventional manner.

Principly, blister copper is produced from sulphidic copper material by methods comprising three stages these being a first stage in which the material is roasted, a second stage in which the roasted product is smelted and a third stage in which the copper-sulphide smelt is converted to blister copper by blowing or injecting into the smelt an oxygen-containing gas, normally air, the iron oxides being slagged at the same time, by adding an acid flux, such as silica, e.g. sand, to the process. A characteristic feature of such conventional copper processes is that they are all effected in stages. By roasting the sulphidic copper material, i.e. heating the material by supplying oxygen to combust sulphur present in the material, there is obtained a partial combustion of sulphide sulphur (i.e. the sulphur contained in the sulphide), this combustion process being controlled to ensure that the roasted product contains sufficient sulphur to form a matte having the desired copper content during the subsequent smelting process. Normally, the matte contains 30–40% copper and 22–26% sulphur. The chemical composition of the matte will, of course, vary in dependence upon the nature of the ingoing raw material and the extent to which roasting is effected. The aforementioned copper and sulphur ranges, however, are representative of matte produced from those copper raw-materials most commonly used.

In addition to obtaining matte whenm smelting sulphidic copper material, there is also obtained an iron-containing slag which is imparted a suitable composition by adding sand ($SiO_2$) and, in certain cases, minor quantities of limestone, thereby to impart a low viscosity to the slag. The slag, which normally contains approximately 0.4–0.8% copper, is tapped-off and discarded. In certain cases the slag may also contain significant quantities of zinc and other valuable metals, which metals can be recovered in slag-fuming processes.

In conventional, batchwise, smelting processes, the copper content of the matte is regulated to 30–40%, since a higher copper content would result in a higher copper content of the slag, which would lead to unacceptable copper losses.

Over the years, a number of mutually different smelting furnaces have been constructed. The design of these furnaces is normally such as to require copper raw-materials together with a slag-former to be continuously charged to the furnace and there smelted. The slag and copper matte can be tapped-off continuously or discontinuously.

A usual type of smelting furnace in this context is the reverberatory furnace comprising, in principle, a long and narrow furnace space having a rectangular bottom, the furnace space being heated by means of oil or gas burners. Air, or air enriched with oxygen-gas is charged to the furnace for the oil or gas combustion. Reverberatory furnaces are now being replaced to an ever increasing extent by other types of smelting furnaces, partly for reasons of an economic nature and partly for reasons of an environmental nature, since it has been found extremely difficult to recover effectively the sulphur dioxide-containing gases generated during the smelting process. Reverberatory furnaces namely generate large volumes of gas, which means that large and expensive gas-purification systems must be provided. One way of avoiding this problem is to smelt the material by means of electrical energy. An electric smelting furnace suitably comprises a long and narrow surface space having a rectangular bottom in which electrodes are arranged, normally electrodes of the Söderberg type, which are intended to be immersed in the material to be smelted. The energy required to carry out the smelting process is obtained by resistance heating techniques. The electric furances represent a considerable step forward in the art and improve the possibilities of purifying and recovering generated gases, owing to the fact that the furnace can operate under a specific, controllable pressure lower than the ambient pressure, so as to avoid unacceptable leakage of deletorious substances from the furnaces, which substances may be harmful to the environment, and because less gas need be generated than that generated in the reverberatory furnace, thereby enabling smaller gas-purification systems to be used. In order for electric smelting furnaces to be economic, however, access must be had to inexpensive electric power.

The aforementioned smelting processes normally provide a copper matter containing 30–40% copper, and an outgoing slag containing between 0.4 and 0.8% copper, this slag being discarded. It is desirable, however, to produce in the smelting process a matte with the highest possible copper content, for example a copper content of 60–77%, preferably 65–75% Cu. The production of a smelt of such high copper content has not been possible in hitherto known copper-smelting processes, however, because too much copper is lost to the slag. When converting matte having a low copper content in discontinuous Pierce-Smith converters or in previously known processing apparatus according to known processes, a very large quantity of slag containing 4–8% copper is obtained, which slag must be returned to the smelting process or cooled down, crushed and subjected to flotation processes in order to recover the copper content of the slag. This incurs significant expense. A further disadvantage encountered in known copper conversion processes, is that part of the iron contained by the slag is oxidized to form magnetite, which owing to its high melting point will remain substantially in solid form and settle in the melting unit to form deposits therein when the slag is returned.

It has been found in practice that if the copper content of the matte is raised during smelting process to more than 40%, the copper content of the slag will be so high as to render the copper losses unacceptable.

A further disadvantage with the aforementioned smelting processes is that the copper material must normally be sintered or roasted before it is charged to the furnace. Consequently, in latter years smelting apparatus have been developed in which it is possible to smelt copper concentrates directly and in which the heat used to effect the smelting process is provided by heat generated upon the combustion of sulphur contained in the concentrates, i.e., by so-called autogenous smelting. One such furnace is the so-called flash-smelting furnace which, in principle, comprises a vertically arranged reaction shaft, a horizontally arranged settling-furnace portion for the molten material and a waste-gas section. Pre-heated air and dried concentrates are charged to the top of the reaction shaft. An exothermic reaction takes place in the tower between the oxygen in the air and the sulphur in the copper concentrate, the concentrate particles reaching smelting temperature and then falling down into the settling-furnace portion, in which they form a molten bath comprising copper matte and slag. Normally, the slag is tapped continuously from such furnaces whilst the copper matte is tapped off discontinuously. The copper content of the matte can be regulated by controlling the supply of oxygen to the process, the copper content normally lying at about 60% and the slag containing 0.8–2.0% copper. Since slag containing such large quantities of copper must be refined, for economic reasons, the slag is treated in a separate furnace in which the copper content can be reduced to 0.4–0.8%.

In addition to furnaces of the aforementioned type (Outokumpu) other furnaces of the INCO type can be mentioned, these furnaces operating in accordance with the same principles, the main difference being that furnaces of the Outokumpu type use pre-heated air when smelting the concentrate in the shaft, while the furnaces of the INCO type use oxygen-gas enriched air in the absence of a flash shaft.

In addition to the high copper content primarily obtained in the slag, a further disadvantage encountered with flash furnaces is that they are unsuitable for melting scrap and/or oxidic material.

Copper matte produced in accordance with previously known processes is subsequently transferred to a copper converter in which residual sulphur is oxidized, by blowing air or oxygen-containing gas into the converter in a conventional manner, to form blister copper and sulphur dioxide.

During the past years a multiplicity of continuous copper-producing processes have been developed, in which the steps of smelting the raw-materials, slagging the iron contained in said materials and converting the resultant matte to blister copper are all carried out in a single furnace or in a plurality of mutually combined units. Normally, blister copper and slag are tapped continuously from the furnace. A continuous copper-producing process was described as early as 1898 by Garrison in U.S. Pat. No. Spec. 596,992, in which the steps of smelting copper-containing materials and converting the same to copper, and separating the copper from the slag were all effected in one and the same furnace.

Thus, the above U.S. Patent Specification describes the continuous smelting of sulphides in a furnace heated by fuel-burners and having a long, narrow bottom which slopes but very slightly. The matte obtained thus flows continuously to one or more separate but interconnected converters arranged in series at one end of the furnace. The matte is blown continuously to form metal which is tapped-off. The slag obtained, which is rich in copper, flows continuously back in counter-current to the matte, through the furnace to a separate but communicating slag-separating zone at the other end of the furnace and is subjected there to heat and to a reduction process with charcoal; copper which is reduced-out is taken up into the matte, which is separated and permitted to flow back to the furnace, whereafter the thus purified slag is tapped-off.

In 1954 there was described in U.S. Pat. No. Spec. 2,668,107 (INCO) a process comprising the autogenous smelting of copper-sulphide and nickel-sulphide concentrates by injecting dry sulphides and a flux by means of oxygen gas, optionally also air, into a closed furnace. Matte or white metal, and slag forms continuously and is collected on the bottom of the furnace, whereafter the matte or white metal is tapped from one end of the furnace and the slag from the other end. According to this patent, the metal-rich slag is purified in counterflow to the matte. The slag is allowed to pass a threshold or barrier in the hearth so as to separate the slag from the matte and the white metal and other metals formed, whereafter the slag is treated with a shower of molten matte droplets having a low copper content but rich in iron sulphide, whereafter the slag thus treated is tapped-off.

In the U.S. Pat. Nos. Spec. 3,004,846 and 3,030,201, 3,069,254, 3,468,629, 3,516,818, 3,615,361 and 3,615,362 (INCO) processes are described for converting copper-sulphide, nickel-sulphide and lead-sulphide materials into corresponding metals in rotary furnace units. Oxygen is injected into the furnace from above by means of downwardly projecting gas lances through which process gases of adjusted composition and of the desired temperature are directed onto and through the surface of the bath. These patents emphasize the importance of creating sufficient agitation in the furnace to ensure effective contact between the gases, the solid substances and the liquid material in the furnace, since in this way the removal of iron, sulphur and impurities, such as antimony and arsenic, is effectively promoted. When applying this principle, requiring a turbulent bath, the heat transfer and the rate at which chemical reactions take place are increased, owing to a significant decrease in the diffusion barriers between slag and sulphide phase. According to "Western Miner" November 1975, page 16–19, a copper-producing plant which is to operate in accordance with the aforementioned processes is planned in Canada.

In a publication by R. Schumann, Jr. in transactions AIME Vol. 188, 1950, page 8, "A Survey of The Thermodynamics of Copper Smelting" there is presented a thermodynamic analysis of conditions prevailing when smelting and converting mixtures of copper sulphides and iron sulphides to form copper metal and slag. This article reveals the importance of the activity of oxygen and sulphur, respectively, in the system, these activities being accorded the highest significance in respect of the thermodynamic relationships in copper smelting processes. The publication shows that in typical matte-slag systems, the equilibrium pressure can be varied over a wide range. This fact shows that it is difficult to optimize the copper content in the slag and matte in a manner such that the resultant copper content of the slag is sufficiently low and that the matte contains a sufficiently high content of copper. The partial pressure of oxygen at equilibrium in the system depends upon three stoichiometric factors determined by the material charged to the furnace, namely the matte concentration, the silica content of the slag and the ratio of oxygen to iron, the oxygen in the silica being discounted, and by the temperature.

During latter years many different processes have been proposed in attempts to solve problems encountered with the pyrometallurgical conversion of sulphide concentrates to metal in a continuous process, for example such processes as those described in the U.S. Pat.

Nos. Spec. 3,326,671 (Worcra), 3,542,352 (Noranda) and 3,687,656 (Metallgesellschaft).

In spite of all the efforts made, some serious problems still remain. The U.S. Pat. No. 3,326,671 describes a number of different furnace constructions for a process based on the concept of a furnace divided into three zones. When the process gases are injected from above through downwardly extending overhead tuyeres, or lances, complications and limitations are met in the operation of furnaces not provided with particular agitation means, mainly because the reactions are slower. If the speed at which the gas passes through the furnace is increased, so as to obtain more effective and rapid reactions, high dust losses are experienced, especially when the furnace is charged with dry concentrates which have not been sintered. (Compare U.S. Pat. No. 3,326,671, page 9, line 31). Furthermore, such a method renders it extremely difficult to produce a slag having the desired low copper content, since it is difficult in one and the same furnace unit to work simultaneously with a strongly oxidizing zone in close proximity with a strongly reducing zone, despite the fact that the slag in the reducing zone is not in direct contact with the matte or white metal (i.e., phases of higher copper content), the physical separation of the slag from matte or white metal being achieved by arrangements of structural members, such as threshold-type barriers.

The U.S. Pat. No. Spec. 3,542,352 describes a method in which, when smelting concentrate, there is applied a concurrent-process, while when separating copper from slag there is applied, subsequent to the slag having passed a threshold, barrier, a counter-flow process thereby to avoid contact between white metal and copper. In order to separate copper from the slag, a reducing gas is blown thereinto, the copper being reduced and running back to the main body of white metal and copper, said body being collected in front of the threshhold in the furnace, from where it is tapped-off continuously. The slag is also tapped-off continuously. The disadvantage with the aforedescribed process is that copper reduced out from the slag also dissolves impurities in the raw material, such as antimony and bismuth, which metals can cause serious disturbances in the subsequent electrolytic refinement of blister copper. The slag will also contain relatively high percentages of copper, which means that the slag must be treated subsequent to being tapped-off, either by flotation or by sulphide-treating processes effected in a separate furnace. The copper content of the slag reaches 9–12%, it being possible to reduce this content somewhat by reduction.

The U.S. Pat. No. Specification 3,687,656 (Metallgesellschaft) describes a semi-continuous method in which a series of complicated treatment stages are effected in a multi-chamber unit in which process gases are injected through downwardly directed gas lances.

The German Patent Application No. 2,322,516 (Mitsubishi) describes a method of continuously producing blister copper in three separate stages, these stages comprising a smelting furnace, a slag-purification furnace and a converter. In comparison with other continuous copper-producing processes, it is possible by the method of this German Application to control the slagging procedure more favourably. One disadvantage, however, is that the continuously operating smelting furnace can only be operated under oxidizing conditions, which results in a slag having a high copper content. According to the description of the German Application, it is preferred to control the process in a manner such that only 60% of the copper contained in the sulphidic copper raw-material is recovered in the smelting process, since a higher content of copper in the matte would result in a very high copper content of the slag, the slag then being passed further to the slag purification furnace. When the smelting process is effected under oxidizing conditions, the slag will also contain high percentage of magnetite, which renders the slag highly viscous and difficult to handle.

In accordance with a recently published method, designated KIVCET, Erzmetall 28, pages 313–22 (1975) complex copper concentrates are charged to a furnace space in a vortex and smelted in said space, the smelt distributing itself between said furnace space and a further furnace space where reducing conditions are maintained whilst, for example, vaporizing zinc and other impurities. The smelting process in the first furnace space is effected under oxidizing conditions and flue gases are removed, by suction, to a purification plant. The atmosphere in the further furnace space is a strongly reducing atmosphere and hence the predominant portion of metallic impurities will be present in the matte phase, naturally with the exception of zinc and lead which depart in vapour form. Under special conditions it is also possible to vaporize tin and arsenic. The furnace, however, is not constructively suitable to control the conditions in the two furnace spaces and the possibility of obtaining desired conditions is apparently limited, particularly in the further furnace space.

Because of the oxidizing conditions maintained when smelting copper concentrates in accordance with the KIVCET method considerable quantities of magnetite are formed and hence the temperature must be maintained at a very high magnitude — 1600°–1800° C. — if a liquid slag is to be formed. This high temperature represents a serious disadvantage with respect to energy consumption and, in addition, the materials from which the furnace is constructed are seriously affected.

Despite the large number of processes known for producing copper, it has now surprisingly been found possible to devise a new process which offers a large number of advantages vis-à-vis the previously known processes.

The invention consists in a method of producing blister copper, wherein sulphidic copper raw material is smelted to form a matte and a slag in a rotary furnace arranged to rotate about an inclined axis at a rotary speed of from about 10 rpm to about 60 rpm in the presence of oxygen and slag formers and wherein the matte is converted to blister copper in the manner known per se, which method comprises the steps of heating the furnace to a temperature of at least 900° C. charging simultaneously the copper raw material, slag former and oxygen to the furnace to autogeneously smelt said raw material by means of heat obtained by burning sulphur contained in said raw material, so that a smelt comprising a matte having a desired copper content and a copper-containing slag is formed and maintained at a temperature of 1100°–1300° C.; treating the smelt obtained with at least one reductant selected from the group consisting of coke, coal, oil, natural gas, pyrite, chalcopyrite, pyrrhotite and additional amounts of said sulphidic copper raw material, so that the copper content in the slag is decreased; transferring the smelt batchwise to a holding furnace in which the matte and the slag are mutually separated; reducing the slag in the holding furnace during its passage therethrough by any manner known per se to further decrease the copper content in the slag to a predetermined level; tapping off the matte separated in the holding furnace and transferring it to a converter; and finally tapping-off the slag thus reduced and separated.

The new process of the present invention comprises a surprising combination of known integers, which combination enables copper to be produced from widely differing raw materials, such as concentrates, copper-containing cinders and ashes and copper scrap. The method comprises charging sulphidic copper smelt material to a rotary furnace having an inclined axis of rotation, in which furnace the copper material is smelted whilst supplying oxygen and slag former to the furnace, although it must naturally be ensured that the sulphur content and oxygen content of the process gas supplied is sufficient to smelting the copper material in the manner desired. Thus, the oxygen content may vary between 25 and 100%, although a content of 30–50% is preferred. The resultant melt, comprising matte and slag, is then treated with a reductant. The whole melt, matte and slag, is then transferred to a holding furnace in which the slag and matte are mutually separated. The slag is further treated in the holding furnace to reduce the copper content of the slag, whereafter the slag is tapped-off, optionally for further treatment in a vaporizing furnace to recover zinc. The matte is transferred to a converter in which it is converted to blister copper in a manner known per se. Because of the reducing atmosphere, the magnetite content can be reduced to approximately 2%, which provides a slag of the required fluidity. Further, because the furnace rotates, it is possible to prevent the zinc present from vaporizing and accompanying the waste gas even though the magnetite content is so low. This is not at all possible in conventional processes. The oxygen supply is suitably discontinued when at least 75%, and preferably at least 85% of the copper raw material has been charged to the furnace. The remaining sulphidic copper raw material will then act as a reduction agent. Alternatively, all of the copper raw material may be charged to the furnace whilst supplying oxygen thereto, whereafter a reductant, such as coke, coal, oil, pyrite, chalcopyrite, or pyrrhotite, is charged to the furnace. During the smelting process, the temperature is maintained at between 1100° and 1300° C., preferably between 1150° and 1250° C. Prior to charging copper raw material to the furnace, the furnace is heated to a temperature of at least 900° C. by means of a burner.

The temperature of the holding furnace is maintained at 1150°–1250° C. with the aid of a burner or by means of resistance heating. The copper content of the slag is reduced in the holding furnace either by charging sulphidic concentrates, coke or coal to the furnace or by combusting a fuel therein with a reducing flame.

The novel process affords new and surprising advantages which, surprisingly, have not been previously realised by one skilled in this art, despite the fact that the problems associated with previous methods have been obvious.

The amount of energy consumed by the process is low, since the heat required for smelting the raw copper material is obtained by burning sulphur contained in the copper concentrate, i.e., so-called autogenous smelting. Smelting of the raw copper material can be effected with either roasted products obtained from conventional roaster furnaces or with copper concentrates, which may also be moist. With autogenous smelting there is obtained a significant surplus of heat, especially when only oxygen gas is used, which surplus can be used to smelt copper scrap and/or be recovered in a waste heat boiler. The smelting process may suitably be remotely controlled from a control room, whereby no person need remain in the reactor hall during normal operation, thereby enabling difficultly solved internal environmental problems to be solved. Furthermore, the smelting unit itself may be so constructed as to be exchangeable with another, so that repair work, such as relining the furnace, may be done in places suitable therefor, thereby further improving internal environmental conditions. Since it is possible to construct the reactor hall in such a manner that it is in effect a closed locality, recovery and purification of process gases is greatly facilitated and the soiling of the ambient environment avoided thereby.

The smelting unit used in accordance with the new method is a rotary furnace which, in operation, rotates about an inclined axis. An example of such a furnace is the Kaldo converter which is also designated as top-blown rotary converter. Such a converter is arranged to rotate at such speeds that material is entrained from the bath by the wall and caused to fall down as droplets into the bath, thereby providing for particularly effective contact between the bath and the gas phase existing above the surface of the bath, thereby enabling very fast reactions to take place and to maintain equilibrium between the various parts of the bath. This speed can be calculated suitably as the peripheral speed of the inner wall of the cylindrical part of the furnace. The speed should be from 0.5 to 7 m/s, preferably from 2 to 5 m/s. This corresponds to a rotary speed of 10–60 r.p.m. depending upon the diameter of the furnace. A large furnace, in the order of magnitude of 5 m diameter, can reach a suitable peripheral speed already at a rotary speed of 10 r.p.m. while a very small furnace, less than one meter in diameter, should have a rotary speed of more than 40 r.p.m. The Kaldo converter is described exhaustively in, for example, Journal of Metals, April 1966, pages 485–490, and in Stahl und Eisen 86, (1966) pages 771–782.

As will be seen from this literature, a Kaldo converter comprises a cylindrical portion and a conical top section. The converter has a refractory lining and is provided with means by which it can be rotated at speeds of 10–60 r.p.m., these means having the form, for example, of a friction drive or a toothed-drive ring extending around the container and suitable drive means associated therewith. The whole of the rotatable converter together with the means for rotating the same can be tipped to the tap furnace. In other respects, the kaldo furnace is provided with conventional auxiliary equipments, such as supply devices, tuyeres or lances, gas purification equipment and control apparatus.

By charging raw material batchwise to a rotary furnace having an inclined axis of rotation, relatively rapid reactions are obtained and the process can be readily controlled by means of data processing apparatus, whereby the process can be quickly adjusted should the incoming raw material vary. Thus, the process affords important advantages, since a widely varying assortment of raw materials can be smelted and metal lurgically treated with the desired result.

The holding furnace suitably has the form of a horizontally arranged furnace space, for example a long narrow furnace space having a rectangular bottom surface, in which material is charged at one end and slag and matte are allowed to mutually separate during passage through the furnace. The slag is tapped-off at the other end of the furnace, slag being conveyed from the charging end of the holding furnace towards the slag-removal end. During its passage through the holding furnace, the slag is treated by adding sulphidic concentrates and/or a reductant such as coke or coal. Further, a reducing gas flame can be used for the reducing treatment process. As a result hereof, the copper content of the slag can be maintained at very low levels. This process also provides a sufficiently long treatment time, even if the process in the smelting stage is relatively rapid. Heat is applied to the holding furnace by using electric resistance heating techniques, such as Söderberg electrodes, or by means of a gas burner, which may be combined with the reducing treatment of the slag.

The matte, which contains very high percentages of copper, 65–75%, is then transferred to a converter of, for example, the conventional PS-type. The conversion of the matte may also be effected in a Kaldo converter, when this is found suitable, e.g. when it is desired to carry out simultaneously certain metallurgical treatment steps, such as steps in which the antimony content of matte is lowered. A conventional converter is preferred, however, when no special conditions prevail. Owing to the high copper content of the matte, small quantities of slag are formed during the conversion process, these affording important economic gains compared with previous methods since the converter slag is always very rich in copper, normally 6–8% copper.

A matte may contain between 18 and 77% copper and, in commercial copper processes, normally contains 30–60% copper. A matte having more than roughly 75% copper, may be termed a concentrated matte or white metal.

Thus, the process according to the present invention provides for extraordinary flexibility.

Since the smelting unit can be exchanged for a further smelting unit, stoppages in production caused by repair work are avoided and, except for the rare occasions when the holding furnace must be closed down for maintenance work, the system can be driven continuously. It is also possible, at times, to permit matte to be transferred from the rotary furnace directly to the converters, even though in such cases a somewhat poorer copper yield is obtained, since the slag will have a slightly higher copper content. Slag which has a slightly higher copper content can, if desired, be charged to the holding furnace when this furnace is again in operation. This is an extremely important advantage vis-à-vis the large number of copper processes based on integrated processes in one or more separate furnaces, in which when one process stage is closed down it is necessary to empty the plant and completely interrupt production. In order to safeguide against stoppages in production still further, the process apparatus may comprise a multiplicity of smelting units.

The process is illustrated schematically in the accompanying drawing, the single FIGURE of which shows a rotary furnace 1 having an inclined axis of rotation, the furnace beng charged with copper raw material in the direction of arrow 2. When the furnace has been charged and the melt treated with a reductant, both the matte and the slag are transferred to a holding furnace 3 in the manner indicated by the arrow 4. The matte is transferred from the holding furnace 3 via means indicated by arrow 5 to a converter 6, while the slag is transferred to a zinc-vaporizing apparatus or a granulating apparatus via means indicated by arrow 7, and discarded. Copper is removed from the converter 6 by means indicated by arrow 8. Slag formed in the converter is returned to either the furnace 1 or the holding furnace 3 by means indicated by arrow 9.

The invention will now be illustrated with reference to a number of examples:

EXAMPLE 1

Fine-grain concentrate and slag former, $SiO_2$, such as sand, were charged continuously through a water-cooled lance to a Kaldo furnace having a capacity of approximately 5 tons whilst simultaneously charging oxygen, alternately oxygen-enriched air, through the lance in quantities as to obtain a matte smelt having the desired copper content. The oxygen content of the air charged to the furnace was adjusted so that the material charged to the furnace could be smelted autogeneously, this being achieved with an air charge containing 30–50% $O_2$. Thus, the oxygen content must be adjusted in accordance with the composition of the concentrate and to its moisture content and should in general be maintained within the ranges given for the majority of material. Subsequent to reaching the desired copper content of the matte, the air supply was discontinued whilst concentrates continued to be charged to the furnace until a further, approximately 10%, concentrates had been charged, whereby the copper content of the slag was reduced. During the reduction period, the furnace was kept heated by means of an oxygen gas-oil burner. Subsequent to the termination of the reduction period, the matte and the slag were tapped-off together, transferred and charged into one end of a rectangular holding furnace, in which sulphidic material was charged to one end thereof so as to reduce the percentage of copper in the slag to less than 0.4% in a manner known per se before tapping-off the slag. The matte was transferred to a conventional Pierce-Smith converter, in which the matte was blown with air to form copper.

| | % Cu | | % Fe | | % $SiO_2$ | | % $Fe_3O_4$ | |
|---|---|---|---|---|---|---|---|---|
| | Test Number | | | | | | | |
| Result | 1 | 2 | 1 | 2 | 1 | 2 | 1 | 2 |
| Matte prior to reduction | 65 | 77 | 5.5 | 1 | — | — | — | — |
| Matte after reduction | 63 | 74 | 6.5 | 1 | — | — | — | — |
| Slag prior to reduction | 2.0 | 3.9 | 33 | 33 | 32 | 32.5 | 7 | 14 |
| Slag after reduction | 0.8 | 0.9 | 34 | 35 | 33 | 33 | 5 | 7 |

As shown by the results of the two tests, subsequent to smelting raw copper material in the Kaldo furnace there was obtained a matte having a very high copper content whilst the copper content of the slag was very low, less than 1%. Slag having such low copper content cannot be obtained with previously known methods, despite the fact that the copper content of the matte has been much lower in said methods. The low copper content of the slag enables the holding furnace to operate continuously, since a further reduction of the copper content to less than 0.4% can be vary rapidly achieved by treating the slag with sulphidic concentrates, coke or a reducing flame in the manner aforementioned.

Another example illustrates still more the high degree of flexibility of the copper process, since surprisingly it is possible to smelt and beneficiate antimony-rich copper raw material having >0.2% antimony without the antimony content of the copper produced subsequent to conversion exceeding 400 g/t, which is necessary if it is to be possible to carry out a troublefree electrolysis in the final electrolytic-refining of the anode copper.

Another object of the invention is thus a method of smelting copper raw materials containing more than 0.2% antimony to a matte whilst simultaneously removing the antimony from said material, wherein the said copper raw materials are smelted in an inclined, rotary furnace together with an addition of iron containing slag, said iron containing slag being charged to the furnace in quantities such that the total amount of iron present in the furnace is at least 44 times of the antimony present in the furnace, whilst supplying heat from a burner, whereafter the resultant matte smelt, subsequent to tapping-off the slag, is converted in the same furnace by blowing with an oxygen containing gas through lances, to form white metal and a further slag, whereafter said further slag is removed.

The smelting is effected during a first phase by supplying heat from the burner with a reducing flame, preferably with an oxygen quantity charged corresponding at most 80% of the stoichiometrically required quantity, and during a second phase with an oxidizing flame, preferably with an oxygen quantity charged corresponding to at least 120% of the stoichiometrically required quantity. The temperature is increased to between 880°–980° C. by means of the reducing flame and to 1150°–1300° C. by means of the oxidizing flame. The furnace rotates with a peripheral speed at the cylindrical inner wall of the furnace of from 0.5 to 7 m/s, and preferably from 2 to 5 m/s.

Antimony will readily accompany the copper and the problem is serious especially if it is desired to produce a matte having a high copper content, 65–75% copper. In previously known processes there is also formed in such cases a minor quantity of metallic copper which immediately dissolves practically all the antimony present. The method comprises smelting the copper raw material in an inclined rotary furnace together with an addition of iron-containing slag in quantities such that the total quantity of iron in the furnace is at least 44 times the amount of antimony present in the furnace. Heat is supplied by means of a burner suitably fired with oil and oxygen gas, smelting suitably taking place in two different phases, in which the first phase is effected in a reducing atmosphere, i.e., with a smaller quantity of oxygen than that corresponding to the stoichiometric quantity required to completely combust the oil supplied, while the second phase is effected under an oxidizing environment, i.e., with an oxygen quantity exceeding the stoichiometrically required amount for combusting the oil supplied. Thus, approximately 80% of the stoichiometric oxygen requirement is used during the first phase and approximately 120% during the second phase. The first phase is conveniently continued until the charge is heated to a temperature of 850°–950° C. and the second phase is conveniently continued until a temperature of 1150°–1300° C. has been reached.

EXAMPLE 2

1500 kg of roasted copper raw material and 450 kg of fayalite slag were charged to an inclined rotary converter which has been preheated to 1000° C. The composition of the roasted material was mainly as shown in the following table:

0.59% : Sb
35.2% : Cu
20.9% : S
28.7% : Fe
11.7% : $SiO_2$

The composition of the slag was:

35% : Fe
65% : $SiO_2$

The charged material was smelted with heat produced by burning oil in an oil oxygen-gas burner.

Heat was applied to the charged material for 24 minutes with a reducing flame, i.e., the amount of oxygen supplied was less than that corresponding to the stoichiometric requirement. The ratio of oil, in litres, to oxygen gas, in normal cubic meters, was 3:4.8. The temperature in the inclined rotary converter was raised to 900° C. Heat was then applied with an oxidizing flame for 26 minutes, i.e., the amount of oxygen supplied was greater than that corresponding to the stoichiometric requirement. The ratio of oil, in liters, to oxygen, in normal cubic meters, was 3:7.5. In this way the temperature of the smelt was raised to approximately 1200° C. The antimony content of the matte was determined at 0.33% Sb and the copper content at 48.3%.

The matte was then converted to white metal in the inclined rotary converter by treating the matte with oxygen gas. The resultant white metal contains 78.0% copper and 0.08% antimony. In this instance the amount of silica present was sufficient to slag the iron present. The ratio of iron to antimony in the ingoing roasted material was 49.5:1.

EXAMPLE 3

A series of tests were carried out in order to determine the quantities of iron required to effectively lower the antimony content. The tests were carried out in accordance with the disclosures in Example 1 but with varying amounts of iron with respect to quantity of antimony present. The separate results are given in the table below.

| Test Number | Fe:Sb | % Sb in matte |
|---|---|---|
| 1 | 51.3 | 0.38 |
| 2 | 58.5 | 0.33 |
| 3 | 49.0 | 0.33 |
| 4 | 42.3 | 0.50 |
| 5 | 38.9 | 0.52 |
| 6 | 46.9 | 0.33 |

It will be seen from the Table that if the ratio of iron to antimony falls below 44:1 there is, what can be termed, an explosive increase in the residual antimony content from approximately 0.35 to approximately 0.5. An antimony content of approximately 0.35 is sufficiently low to enable anode copper containing less than 400 g antimony per ton copper to be produced, which enables the electrolysis to be carried out without generating trouglesome floating slime.

We claim:

1. A method of producing blister copper, wherein sulphidic copper raw material is smelted to form a matte and a slag in a rotary furnace arranged to rotate about an inclined axis at a rotary speed of from about 10 rpm to about 60 rpm in the presence of oxygen and slag formers and wherein the matte is converted to blister copper, which method comprises the steps of heating the rotary furnace to a temperature of at least 900° C.; charging simultaneously the copper raw material, slag former and oxygen to the rotary furnace to autogeneously smelt said raw material by means of heat obtained by burning sulphur contained in said raw material, so that a smelt comprising a matte having a desired copper content and a copper-containing slag is formed and maintained at a temperature of 1100°-1300° C.; treating the smelt obtained with at least one reductant selected from the group consisting of coke, coal, oil, natural gas, pyrite, chalcopyrite, pyrrhotite and additional amounts of said sulphidic copper raw material, so that the copper content in the slag is decreased; transferring the smelt batchwise to a holding furnace in which the matte and the slag are mutually separated; treating the slag in the holding furnace during its passage therethrough to further decrease the copper content in the slag to a predetermined level; tapping-off the matte separated in the holding furnace and transferring said matte to a converter; and finally tapping-off the slag thus reduced and separated.

2. A method according to claim 1, wherein the slag in the holding furnace is treated by charging sulphide concentrates to the holding furnace.

3. A method according to claim 1, wherein the reductant comprises additional amounts of sulphidic copper raw material, comprising discontinuing the supply of oxygen when at least 75% of the copper raw material has been charged to the furnace.

4. A method according to claim 1, wherein the oxygen charged to the furnace during the smelting process has the form of a gas containing 30–50% oxygen.

5. A method according to claim 1, wherein the temperature of the holding furnace is maintained by electric resistance heating or by combusting fuel.

6. A method according to claim 1, wherein the reduction is effected in the inclined rotary converter in a manner such that the copper content of the slag phase is less than 2%.

7. A method according to claim 1, wherein the copper content of the slag in the holding furnace is reduced to less

8. A method according to claim 1, wherein the temperature is maintained at 1150°-1250° C.

9. A method according to claim 1, wherein the temperature of the holding furnace is maintained at 1080°-1250° C.

10. A method according to claim 1, wherein the reduction in the holding furnace is effected by supplying coke, or coal, or by means of a reducing flame.

* * * * *